United States Patent [19]

Lamberti

[11] 3,954,649

[45] May 4, 1976

[54] DETERGENT COMPOSITIONS CONTAINING COATED PARTICULATE CALCIUM SULFATE DIHYDRATE

[75] Inventor: Vincent Lamberti, Upper Saddle River, N.J.

[73] Assignee: Lever Brothers Company, New York, N.Y.

[22] Filed: Sept. 16, 1974

[21] Appl. No.: 506,160

[52] U.S. Cl. ..... 252/174; 252/89 R; 252/131; 252/133; 252/134; 252/140; 252/539; 427/215

[51] Int. Cl.[2] ..... C11D 3/04; C11D 3/14; C11D 11/02; C11D 17/06

[58] Field of Search ..... 252/131, 133, 539, 140, 252/174, 89, 134

[56] References Cited

UNITED STATES PATENTS

| | | | |
|---|---|---|---|
| 2,766,212 | 10/1956 | Grifo | 252/551 |
| 2,829,110 | 4/1958 | Robson | 252/103 X |
| 3,686,098 | 8/1972 | Weil | 252/550 |
| 3,843,563 | 10/1974 | Davies | 252/547 |
| 3,865,754 | 2/1975 | Norris | 252/532 |

FOREIGN PATENTS OR APPLICATIONS

| | | | |
|---|---|---|---|
| 936,057 | 9/1963 | United Kingdom | 260/41 R |

*Primary Examiner*—Dennis L. Albrecht
*Attorney, Agent, or Firm*—Kenneth F. Dusyn; James J. Farrell; Melvin H. Kurtz

[57] ABSTRACT

Sodium sulfate, the compound commonly used as a filler in detergent compositions, is in short supply, and a suitable substitute for use in detergent compositions is calcium sulfate dihydrate coated with a substantially water-insoluble calcium salt selected from the group consisting of calcium carbonate, calcium silicate, calcium sulfite, calcium orthophosphate, hydroxyapatite and a calcium salt of an alkanoic acid having about 12 to about 22 carbon atoms.

12 Claims, No Drawings

DETERGENT COMPOSITIONS CONTAINING COATED PARTICULATE CALCIUM SULFATE DIHYDRATE

BACKGROUND OF THE INVENTION

1. Field of the Invention

In a detergent composition each component thereof has a distinct function which manifests itself either in manufacture, packaging, storage or use by the consumer.

The majority of commercial household detergent compositions contain (1) a foam-producing, surface-tension lowering substance, commonly referred to as the surfactant or detergent, (2) a detergent builder, usually present in higher proportions than the detergent, to aid the detergent power of the composition, (3) sodium silicate which, in addition to providing buffering action in the higher proportions functions as a builder, and in the lower proportions is employed for its anti-corrosion properties, (4) perfume, (5) anti-redeposition agents, (6) optical brighteners, (7) optionally small amounts of bleaches, colorants, etc., and (8) a detergent filler, or diluent.

The term "detergent filler" as used herein and as applied to detergent compositions, refers to any compatible inert substance employed as a diluent in detergent composition to facilitate the adjustment of the proportions of the other components to desired levels.

It is well known in the detergent art that sodium sulfate has been virtually the only detergent filler, or diluent, employed in fabric washing detergent compositions since the introduction of synthetic detergents for use in this type of composition. Recently however the supply of sodium sulfate has become limited, and substitutes, either partial or complete, are being sought in order to maintain an adequate supply of detergent compositions on the market.

2. The Prior Art

Sodium sulfate has long been the traditional filler for detergent compositions, as exemplified by the disclosures in the text "Synthetic Detergents," Davidsohn and Milwidsky, 5th ed., 1972, page 38, Leonard Hall, London (incorporated herein by reference).

The use of calcium carbonate in a detergent composition is disclosed in Netherlands application No. 7,305,925, bearing Ser. No. 248,546 and a U.S. priority date of Apr. 28, 1972. Therein particulate calcium carbonate, among other substances, having a particle size of less than 20 microns is disclosed as a crystallization seed to hasten crystallization of insoluble salts formed by hard-water cations and builder components, e.g., sodium carbonate, thereby reducing the amount of hard-water cations available to form insoluble derivatives of the detergent component. On the other hand, calcium salts having appreciable water solubility, such as calcium sulfate or hydrates thereof, are not acceptable as detergent fillers because of the resultant increase in the hardness of the wash solution, thereby interfering with the detergency process.

SUMMARY OF THE INVENTION

The present invention is concerned with the provision of a detergent filler for use in detergent compositions.

It is an object of the invention to provide a detergent filler which is calcium sulfate dihydrate in particulate form wherein the particles are coated with a substantially water-insoluble calcium salt.

It is another object of the invention to provide a detergent composition having a detergent filler which is calcium sulfate dihydrate in particulate form wherein the particles are coated with calcium carbonate.

It is a further object of the invention to provide a process for coating particles of calcium sulfate dihydrate with a substantially water-insoluble calcium salt.

Accordingly, the invention provides a particulate calcium sulfate dihydrate having a coating of a substantially water-insoluble calcium salt on the particles thereof. The coating comprises a substance selected from the group consisting of calcium carbonate, calcium silicate, calcium sulfite, calcium orthophosphate, hydroxyapatite and a calcium salt of an alkanoic acid having about 12 to about 18 carbon atoms.

The invention further provides a process for coating calcium sulfate dihydrate with a substantially water-insoluble calcium compound comprising the dispersing of particles of calcium sulfate dihydrate in an aqueous solution of a compound capable of supplying anions which form substantially water-insoluble calcium salts. More specifically the aforesaid compounds are selected from the group consisting of water-soluble carbonates, including carbonates formed in situ by aqueous thermal decomposition of bicarbonates, silicates, sulfites, orthophosphates and alkanoates having about 12 to about 22 carbon atoms.

It is also within the ambit of the present invention to provide a neutral or alkaline particulate detergent composition comprising a surfactant, a detergent builder and a detergent filler which is calcium sulfate dihydrate coated with a substantially water-insoluble calcium salt, all of these being described more particularly hereinafter.

The pH at 25°C of a 0.15% solution of the whole detergent composition is from 7 to about 12, and preferably, from about 9.5 to about 10.5.

DETAILED DESCRIPTION OF THE INVENTION

In accordance with the present invention, particulate calcium sulfate dihydrate is coated with a substantially water-insoluble calcium salt for use as a substitute for sodium sulfate as a filler in detergent compositions.

Suitable substantially water-insoluble calcium-salt coating substances are calcium carbonate, calcium silicate, calcium sulfate, calcium phosphate, hydroxyapatite and a calcium salt of an alkanoic acid having about 12 to about 18 carbon atoms.

The term "coating" as used in this specification shall mean both incomplete as well as substantially complete covering of the calcium sulfate dihydrate particles by the insoluble calcium salts heretofore described. In the case of incomplete coatings, heterocrystalline aggregates composed of calcium sulfate dihydrate crystals and crystals or amorphous forms of the insoluble calcium salt interspersed among each other singly and in clusters are also included in this term.

Broadly, the coating process comprises the dispersing of particles of calcium sulfate dihydrate in an aqueous solution of a compound capable of supplying anions which form substantially water-insoluble calcium salts. More specifically, the aqueous solution containing the dispersion of calcium sulfate dihydrate particles may be agitated for as long a period as may be desired, typically for about 10 minutes to about ½ hour, and until a substantially water-insoluble calcium salt forms as a coating on the particles or agglomerated particles of the calcium sulfate dihydrate. At this point the coating process is complete and need be carried no further if the above-described dispersion of coated particles can be used as is. If desired, however, the coated particles may be isolated by filtration or centrifugation and may also be dried, if for example the coated particles are to be dry-mixed with other particulate substances. When the coating medium is a solution of trisodium orthophosphate, hydroxyapatite may comprise all or a part of the coating, if the treating temperature is sufficiently high.

Suitable water-soluble substances for use in the coating process are the water-soluble alkali-metal, ammonium and N-substituted ammonium salts of carbonic, silicic, sulfurous, orthophosphoric acids and alkanoic acids having about 12 to about 18 carbon atoms.

The coating is conveniently applied by either of two procedures, described below in terms of a calcium carbonate coating. For example the particles of calcium sulfate dihydrate may be added to an agitated solution of sodium carbonate, followed by filtration and optimally drying to produce coated particles suitable for use as a filler in detergent compositions. In a second method of coating, the coated particles are prepared in situ in the crutcher as part of the detergent mixing procedure. In this method, part or all of the water at 20°–100°C required for a batch is charged to the crutcher, followed by part or all of the required amount of sodium carbonate and/or sodium silicate. After a few minutes agitation the calcium sulfate dihydrate is added and the agitation continued until a coating of a substantially insoluble calcium salt forms on the particles of calcium sulfate dihydrate. This may require from 1 minute to about 45 minutes, and usually requires from about 10 to about 30 minutes. The remainder of the components of the detergent formulation are then added and the crutching continued in the usual manner.

Alternatively, in the second method, all of the ingredients (i.e., surfactant, carbonate, silicate, etc.) may be charged to the crutcher first with the calcium dihydrate added last. This procedure may also be used to produce a mixed coating (e.g., consisting of mainly calcium carbonate and calcium silicate when both carbonate and silicate components are used).

The first-named procedure above is suitable for preparing coated calcium sulfate dihydrate particles as a separate step for use in a detergent composition. The coated particles may then be mixed with the remainder of the components as a mechanical mixture, or mechanically mixed with a spray-dried composition containing all or some of the remainder of the components, or may be added to the crutcher to be spray-dried as a part of the composition. In these procedures the builder component need not be sodium carbonate.

The second-named procedure above, i.e., the in situ preparation, is suitable in detergent compositions wherein the builder component is solely or partially sodium carbonate.

By the term "substantially insoluble" is meant a solubility in water of about 0.0015% to 0.01% by weight at temperatures encountered in the manufacture or use of the detergent composition containing the coated calcium sulfate dihydrate.

A surprising feature of the invention is the substantial detergency boosting property of the partial coatings wherein the heterocrystalline aggregates containing particles of calcium sulfate dihydrate are in intimate mixture with particles of calcium carbonate. While applicant does not wish to be held to any specific theory, it is postulated that the detergency boosting properties of the heterocrystalline aggregates arise from the protection provided by the presence of the calcium sulfate dihydrate crystals against poisoning of the surfaces of the calcium carbonate crystals or particles. Thus, it is known that the presence of calcium carbonate in sodium carbonate built formulations may act as a seed in wash water containing the formulation for speeding up the precipitation of $Ca^{++}$ hardness ions out of solution as $CaCO_3$. However, under practical washing conditions many crystal surface poisons are present arising mainly from the soil being removed from the clothes. As a result the art teaches that high levels of calcium carbonate crystals are required to obtain useful enhancement of detergency in sodium carbonate built formulations. In the case of the heterocrystalline aggregates of the present invention, however, the calcium sulfate dihydrate crystals act as a scavenger for these crystal poisons thereby maintaining the activity of the calcium carbonate crystals or particles as a seeding surface. Another possible contribution of action of the heterocrystalline masses is that the solubility of the calcium sulfate dihydrate crystals therein is significantly reduced relatively to pure calcium sulfate dihydrate in the heterocrystalline environment thereby preventing or minimizing their solution into the wash water.

In order to insure the effectiveness of the calcium salt coated calcium sulfate dihydrate as a filler in detergent compositions, the calcium salt must be present in an amount of about 10% based on the total combined weight of the calcium salt and calcium sulfate dihydrate. There is no critical upper limit as to the magnitude of the calcium salt presence. Economics dictate that a suitable coating is one wherein the calcium salt is present in an amount of from about 15% to about 75%. Higher calcium salt concentration levels can be utilized but are less economical to produce because of the longer processing times involved.

Calcium sulfate dihydrate is available as a commercial product such as, for example, Terra Alba, supplied by the United States Gypsum Company. The calcium sulfate dihydrate employed in the work exemplified herein has a $CaSO_4.2H_2O$ content of $\geq$ 95%.

A source of calcium sulfate dihydrate is a form known as "Gypsum Sands", obtained from deposits in Arizona, New Mexico and Texas. These deposits contain sodium sulfate, and are useless for purposes requiring more or less pure gypsum, but are quite suitable for purposes of the present invention. The existence of the aforementioned deposits is mentioned in the text "Encyclopedia of Chemical Technology", Kirk-Othmer, vol. 4, 2nd ed., 1964, page 17, Interscience Publishers, New York.

The present invention finds utility in any detergent composition having a neutral or alkaline reaction in aqueous solution. In particular the coated calcium sulfate dihydrate may be employed in household detergents comprising about 5% to about 30% of an organic surfactant, about 10% to about 60% of a detergent builder, and about 1% to about 75% of the coated calcium sulfate dihydrate. Usually the detergent composition will contain sodium silicate, for example, about 4% to about 10%, calculated as sodium silicate solids, as a buffer and/or corrosion inhibitor, or may contain more, up to about 40%, calculated as solids, if the sodium silicate is incorporated to perform the function of a builder. Relatively small quantities of other substances may be included for their utilitarian or esthetic properties, such as optical brighteners, bleaches, colorants, perfume, soil-suspending agents, suds boosters, suds depressants, anti-tarnish agents, enzymes, anti-caking agents, etc. The balance of the detergent may be water. Sodium sulfate may optionally be added if desired, or in many cases will be introduced as an impurity or by-product associated with the surfactant, the coated calcium sulfate dihydrate or other component. The percentage of sodium sulfate, basis detergent composition, may be 0% to about 30%, while the total of coated calcium sulfate dihydrate and sodium sulfate may range from about 3% to about 75%.

When the detergent builder is, for example, substantially entirely sodium carbonate the detergent composition may be prepared by a process wherein the calcium sulfate dihydrate is coated in situ, comprising i. charging into a crutcher about 35% to about 45% water, the percentages being based on the total crutcher charge, by weight, ii. mixing therewith about 10% to about 60% of sodium carbonate, i.e., the soda ash of commerce, iii. adding to the mixture about 1% to about 75% of particulate calcium sulfate dihydrate, iv. agitating the calcium sulfate dihydrate in the mixture until a coating of calcium carbonate forms on the particles of calcium sulfate dihydrate, while maintaining the temperature of the mixture between 20°C and about 100°C, desirably between 20°C and 60°C, and preferably between 20°C and 30°C, v. adding to the mixture 0% to about 30% sodium sulfate, vi. adding about 5% to about 30% of a surfactant having detergent properties to form a built detergent slurry in the crutcher, and viii. spray drying the slurry, the percentages set forth in (ii), (iii), (iv) and (vi) being by weight of the spray-dried detergent composition and the total of the percentages of said coated calcium sulfate dihydrate and sodium sulfate being about 3% to about 75%.

The above process may be carried out in conventional equipment well known to those skilled in the detergent art.

The detergent will normally be of the anionic or nonionic type, but the advantages of the invention will be obtained when the detergent, or surfactant, is amphoteric or zwitterionic such as the betaines and sultaines. The surfactant, however, will be selected consistent with the production of particulate neutral of alkaline detergent compositions.

Examples of anionic surfactants useful in accordance with the invention are the higher alkyl mononuclear aromatic alkali-metal sulfonates, such as alkylbenzenesulfonates having about 9 to about 18 carbon atoms in the alkyl group wherein the alkyl group is derived from polypropylene as described by Lewis in U.S. Pat. No. 2,477,382, or wherein the alkyl group is derived from kerosene, as described by Flett in U.S. Pat. No. 2,390,295, and Rubinfeld in U.S. Pat. No. 3,320,174, or wherein the alkyl group is a straight chain and the benzene nucleus is randomly positioned along the alkyl chain, as described in Baumgartner U.S. Pat. Nos. 2,723,240 and 2,712,530, and in U.S. Pat. No. 2,972,583, or wherein the alkyl group is a hexene dimer or trimer as in McEwan U.S. Pat. No. 3,370,100, or wherein the alkyl group is derived from alpha-olefins, as in Swenson U.S. Pat. No. 3,214,462.

Also there may be employed primary and secondary alkyl sulfates, i.e., $R\text{-}O\text{-}SO_3^-$ compounds wherein R represents an alkyl group having from 10 to 20 carbon atoms such as sodium, potassium and magnesium lauryl sulfate, stearyl sulfate, coconut alkyl sulfate and tallow alkyl sulfate; N-long chain acyl-N-alkyl taurates and the salts thereof wherein the long chain is from 8 to 20 carbon atoms such as sodium oleoyl methyl taurate, sodium palmitoyl methyl taurate, sodium lauroyl methyl taurate and the corresponding acyl ethyl taurates; long-chain alkyl-oxyethylene sulfates wherein the long chain is from 8 to 20 carbon atoms such as sodium or potassium lauryltri(oxyethylene) sulfate, sodium laurylpenta(oxyethylene) sulfate and sodium cetylpolyoxyethylene sulfate; long chain alkyl aryl oxyethylene sulfates wherein the long chain is from 8 to 20 carbon atoms such as ammonium sodium or potassium nonyl-, octyl- and tridecylphenoxy mono- and polyoxyethylene sulfates; long chain acylisethionates wherein the long chain is from 8 to 20 carbon atoms such as sodium or potassium lauroyl- stearoyl isethionate; alkane- or alkene- sulfonates containing 8 to 20 carbon atoms in the alkane or alkene group such as sodium, potassium, or triethanolamine octane-, decane-, tetradecane- or octadecanesulfonate, and octene-, decene-, tetradecene- or octadecenesulfonate; the 2-alkyloxyalkanesulfonates wherein the alkyloxy group has 1 to about 4 carbon atoms, and the alkane group is a straight chain hydrocarbon radical having about 8 to about 22 carbon atoms, such as sodium-2-methoxydecane-, sodium-2-methoxydodecane-, sodium-2-methoxypentadecanesulfonate; sodium-2-ethoxyhexadecanesulfonate, sodium-2-n-propoxyoctadecanesulfonate, and sodium-tert-butoxyeicosanesulfonate.

Also useful are the acyloxyalkane-1-sulfonates wherein the acyloxy group has 1 to about 8 carbon atoms and the alkane group is a hydrocarbon radical of about 11 to about 23 carbon atoms, such as sodium-2-acetoxydecane-, sodium-2-butanoyloxypentadecane, sodium-2-hexanoyloxyoctadecane-, and sodium-2-octanoyloxyeicosanesulfonate; the olefin sulfonates described in U.S. Pat. No. 3,332,880; alkoxyhydroxyalkanesulfonates wherein the long chain is 8 to 22 carbon atoms such as lauryloxyhydroxypropanesulfonate, stearyloxyhydroxyethanesulfonate and tallowoxyhydroxypropanesulfonate; and fatty acid monoglyceride sulfates wherein the long chain is 8 to 22 carbon atoms such as lauric-, myristic-, palmitic and stearic monoglyceride sulfates; alpha-sulfo soap, such as the disodium salt of alpha-sulfo fatty acids wherein the fatty acids are derived from tallow, the sulfosuccinates, such as dioctyl sulfosuccinate, sodium salt, the 2-hydroxyalkyl methyl taurates, such as sodium 2-hydroxytetradecyl methyl taurate, the sulfuric acid esters of polyhydric alcohols incompletely esterified with higher fatty acids, such as the sodium salt of sulfated coconut oil monoglyceride, and compounds known as "Medialans", which are amido carboxylic acids formed by condensing fatty acids of $C_8$-$C_{22}$ chain length with sarcosine, $CH_3NH_2CH_2COOH$. Generally the alkali metal salts are employed.

The well-known soaps may be employed. Operable soaps within the present invention are the sodium and potassium salts of acyclic monocarboxylic acids having chain lengths of about 8 to about 22 carbon atoms. Particularly useful are the salts of unsubstituted fatty acids derived from natural triglycerides, such as tallow, palm oil, cotton-seed oil, olive oil, lard, rapeseed oil, etc., and the so-called "high-lauric" oils, containing over 50% lauric and/or myristic acid esters, generally exemplified by the tropical nut oils of the coconut oil class, including in addition to coconut oil, palm kernel oil, babassu oil, ouri curi oil, tucum oil, cohune nut oil and murumuru oil, and for present purposes, ucuhuba butter, a triglyceride high in myristic acid esters. A particularly useful soap is one prepared from a mixture of about 80% tallow and about 20% coconut oil.

Among the nonionic surfactant materials that can be employed in the detergent compositions of the invention are the Pluronics (trademark of the Wyandotte Chemicals Corp.), formed by condensing propylene oxide with propylene glycol to a molecular weight of about 600–2500 to form a base, followed by condensing ethylene oxide to this base to the extent of about 30 to about 90%, total molecule basis. U.S. Pat. No. 2,674,619 and 2,677,700 describe operable nonionic compounds; compounds formed by the simultaneous polymerization of propylene oxide and ethylene oxide, and containing randomly positioned oxypropylene and oxyethylene groups, and having over 30% ethylene oxide by weight. These and related compounds are described in U.S. Pat. Nos. 2,979,528; 3,036,118; 3,022,335; 3,036,130 and 3,048,548, alkyl phenols having 6–12 carbon atoms in the alkyl portion, (straight or branched) ethoxylated with 6–25 molar proportions of ethylene oxide, ethoxylates of fatty alcohols having 8–18 carbon atoms per mole and 5 to 30 molar proportions of oxyethylene groups, and having at least 52% by weight of ethylene oxide.

Examples of specific nonionic detergent compounds are: branched-chain nonyl phenol condensed with 8–14 molar proportions of ethylene oxide, a mixed $C_{11}$-$C_{15}$ secondary alcohol (Tergitol 15-S) condensed with 9–14 molar proportions of ethylene oxide, a mixed $C_{14}$-$C_{15}$ alcohol made by the Oxo process (Neodol 45) condensed with 9–12 moles ethylene oxide, or a mixture of 65% $C_{14}$ and 35% $C_{15}$ synthetic straight chain primary alcohols condensed with 9–15 molar proportions of ethylene oxide.

Amphoteric or ampholytic detergents include N-lauryl-N'-carboxymethyl-N'-(2-hydroxyethyl)ethylenediamine, alkyl-beta-alanine wherein the alkyl radicals are mixed radicals having the chain length distribution of coconut oil, the alkali-metal salts of protein-coconut fatty acid condensates, the aminopropionates such as alkyl beta-iminodipropionate represented by $RN(CH_2CH_2COOM)_2$ and alkyl-beta-aminopropionate represented by $RNHCH_2CH_2COOM$ wherein R is an aliphatic hydrocarbon radical having about 8 to about 18 carbon atoms, and M is a cation to neutralize the charge on the anion and to confer water solubility on the compound, the betaines, and the sultaines.

Useful betaines may have the structure

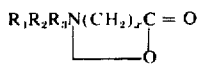

wherein $R_1$ is an alkyl group having about 12 to about 18 carbon atoms or a mixture thereof, $R_2$ and $R_3$ are independently a lower alkyl group having 1 to 3 carbon atoms, and n is an integer from 1 to 4. Specific betaines useful in the products of the invention are for example alpha-tetradecyldimethylammonio)acetate; beta-(hexadecyldiethylammonio)propionate, and gamma-(dodecyldimethylammonio)butyrate.

Useful sultaines may have the structure

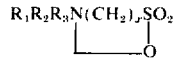

wherein $R_1$, $R_2$, $R_3$ and x are as defined above. Specific useful sultaines are for example 3-(dodecyldimethylammonio)propane-1-sulfonate and 3-(tetradecyldimethylammonio)ethane-1-sulfonate.

Other suitable surfactants for use in the compositions employing the filler of the present invention may be found in the literature, such as the texts "Surface Active Agents" by Schwartz and Perry, and "Surface Active Agents and Detergents" by Schwartz, Perry and Berch, both Interscience Publishers, new York, N.Y., the disclosures of which are incorporated herein by reference.

Cations are usually the alkali metals, but may be alkaline earth metals if sufficient sequestrant is present in the composition. Sodium and potassium are the preferred cations. Sodium is the most practical cation for the production of particulate detergent compositions.

Detergent builders useful in connection with the present invention are compatible substances which enhance the detergent properties of the composition. Examples of useful builders include tetrasodium and tetrapotassium pyrophosphate, pentasodium and pentapotassium tripolyphosphate, sodium or potassium carbonate, sodium or potassium silicates having an $SiO_2$:$Na_2O$ ratio of about 1:1 to about 3.2:1, hydrated or anhydrous borax, sodium or potassium sesquicarbonate, the sodium or potassium aminopolycarboxylates, such as nitrilotriacetates, N-(2-hydroxyethyl)-nitrilodiacetates, ethylenediamine tetraacetates, hydroxyethylenediamine tetraacetates, diethylenetriamino pentaacetates, dihydroxyethyl glycine, phytates, polyphosphonates such as sodium or potassium ethane-1-hydroxy-1,1-diphosphonate, etc.

Also useful are other organic detergent builders such as the sodium or potassium oxydisuccinates, sodium or potassium oxydiacetates, carboxymethyloxysuccinates, hydrofuran tetracarboxylates, ester-linked carboxylate derivatives of polysaccharides, such as the sodium and potassium starch maleates, cellulose phthalates, glycogen succinates semi-cellulose diglycolates, oxidized heteropolymeric polysaccharides, mellitates, citrates, etc.

The invention will be more fully understood by reference to the following examples.

EXAMPLE 1

Calcium sulfate dihydrate may be coated with calcium carbonate by the following process.

Ten grams of $CaSo_4.2H_2O$ are dispersed in 100 ml of water having a hardness of 180 ppm calculated as $CaCO_3$. The dispersion is stirred, 5 gm of $Na_2CO_3$ added, and the mixture heated at 95°C for one-half hour with continued stirring. The mixture is cooled to room temperature, filtered, and the filter cake dried at a temperature of about 50°C in vacuo. The resulting dry powder is gently screened through a 100-mesh screen. Composition: 30% $CaSO_4.2H_2O$, 67% $CaCO_3$ and 3% $Na_2SO_4$ based on analysis for % Ca, % $CO_2$, % S and % $H_2O$. $CaSO_4.2H_2O$ structure confirmed by X-ray analysis.

EXAMPLE 2

This example shows that the substitution of anhydrous calcium sulfate for sodium sulfate in a sodium-carbonate built detergent composition results in lowered detergency. The comparative test is conducted as follows:

The detergent components listed below are individually placed in the cups of a Terg-O-Tometer in amounts corresponding to 1.5 grams of total product having the following compositions:

| | Percent by Weight A | B |
|---|---|---|
| Linear alkylbenzenesulfonate[a] | 18 | 18 |
| Sodium carbonate, $Na_2CO_3$ | 50 | 50 |
| Sodium silicate solids[b] | 10 | 10 |
| Sodium sulfate, anhydrous | 12 | — |
| Calcium sulfate, anhydrous[c] | — | 12 |
| Water, total | 10 | 10 |
| | 100 | 100 |
| Gardner readings (av. of 2) | 58.0 | 55.9 |

[a]sodium salt. The alkyl group averages about 13 carbon atoms.
[b]added as a 46.8% solution; $SiO_2$ to $Na_2O$ ratio is 2.4.
[c]added as the dihydrate.

There are next added to the cup 1000 ml of 180 ppm hard (as $CaCO_3$) water at a temperature of 120°F, followed by four pieces of dacron/cotton cloth measuring 4 ½ × 4 ½ inches, soiled with vacuum cleaner dust. The cloth is washed for 10 minutes at a paddle oscillation rate of 90 complete cycles per minute, then rinsed in 180 ppm hard water for 1 minute. All tests are made in duplicate. The cloth is airdried and the reflectance measured by means of a Gardner Automatic Color Difference Meter, Model AC-3.

The higher the number obtained as a Gardner reading, the whiter is the cloth, and the higher number shown for the sodium sulfate built detergent composition indicate greater detergent power for this composition than for the calcium sulfate built detergent.

EXAMPLE 3

This example illustrates the advantage of employing calcium carbonate-coated calcium sulfate as a filler in a detergent composition.

In this instance, the experiment is carried out in the manner of Example 2, except that the particles of calcium sulfate dihydrate filler are coated with calcium carbonate by the process described in Example 1.

The Gardner readings in the tabulation below show that calcium carbonate-coated calcium sulfate dihydrate when used as a filler in a detergent composition having the formula set forth in Example 2 results in a slight increase in detergency as compared with a sodium sulfate filler.

| Composition | Gardner Readings (Av. of 2) |
|---|---|
| A (sodium sulfate) | 55.6 |
| B (coated calcium sulfate) | 57.9 |

EXAMPLE 4

The coated particles of calcium sulfate dihydrate employed in Example 3 are those that pass through a 100-mesh screen in a careful screening operation to avoid disturbing the coating. However, in a large-scale commercial operation, gentle screening is impractically slow. To determine the effect of rougher handling the coated particles remaining on the 100-mesh screen after the gentle screening operation described in Example 1 are forcibly pressed through the screen roughly handled, and tested as a filler, along with uncoated calcium sulfate dihydrate, coated calcium sulfate dihydrate passing through a 100-mesh screen by gentle shaking as described in Example 1, and sodium sulfate. The comparative tests are conducted as described in Example 2, using the detergent formula employed therein, modified only as required to compare the effects of the fillers.

The Gardner readings below show that the coated calcium sulfate dihydrate particles need not be gently handled as a precaution against damage of the coating during the screening operation.

| Composition | Gardner Readings[a] (Av. of 2) |
|---|---|
| A (sodium sulfate) | 53.2 |
| B (uncoated $CaSO_4.2H_2O$) | 52.0 |
| C (coated $CaSO_4.2H_2O$ through 100 mesh, gently handled) | 55.1 |
| D (coated $CaSO_4.2H_2O$ through 100 mesh, roughly handled) | 54.2 |

[a]the higher the number, the whiter the cloth.

EXAMPLE 5

Calcium sulfate dihydrate particles may be provided with a coating of calcium silicate by the following procedure.

Fifty grams of particulate calcium sulfate dihydrate are dispersed with agitation in 500 ml of water containing 10 grams of sodium metasilicate solids dissolved therein at 80°C. The particles are mixed in the solution for one-half hour, whereby the particles of calcium sulfate dihydrate are coated with calcium metasilicate, and the coated particles form a slurry in the aqueous medium. The slurry may be added as is to the crutcher charge in the preparation of a built detergent crutcher mix for spray drying.

In place of sodium metasilicate having an $SiO_2$:$Na_2O$ ratio of 1:1, sodium silicates having $SiO_2$:$Na_2O$ ratios up to about 3.2 may be employed in the above process.

EXAMPLE 6

Calcium sulfate dihydrate particles may be provided with a coating of calcium stearate by the following procedure.

Fifty grams of particulate calcium sulfate dihydrate are dispersed with agitation in 1000 ml of water containing 15 grams of sodium stearate at 95°C. The water and its contents are mixed for one-half hour to form a slurry of particles of calcium sulfate dihydrate coated with calcium stearate. The slurry may be used as is in a crutcher mix, or the particles may be separated by filtration or centrifugation and dried for dry-mixing with other detergent components.

Sodium or potassium laurate, myristate, palmitate, arachidate or behenate may be substituted for sodium stearate in the foregoing process.

EXAMPLE 7

Fifteen parts by weight of dried calcium carbonate-coated calcium sulfate dihydrate particles prepared as described in Example 1 are thoroughly mixed in a revolving drum with 85 parts by weight of a particulate spray-dried composition having the following formula:

| | Percent by weight |
|---|---|
| Sodium alkylbenzenesulfonate[a] | 12.0 |
| Sodium N-acyl-N-methyl taurate[b] | 12.0 |
| Sodium tripolyphosphate, $Na_5P_3O_{10}$ | 9.0 |
| Sodium carbonate, $Na_2CO_3$ | 9.0 |
| Trisodium carboxymethyloxysuccinate[c] | 35.8 |
| Sodium toluenesulfonate | 3.0 |
| Sodium silicate solids ($SiO_2$:$Na_2O$ ratio = 2.0) | 7.0 |
| Perfume | 1.2 |
| Water, total | 11.0 |
| | 100.0 |

[a]the alkyl group averages about 13 carbon atoms added as a 40.8% solution.
[b]the acyl group has the molecular weight distribution of coconut oil fatty acids.
[c]prepared as described in U.S. Patent No. 3,692,685, assigned to the instant assignee.

EXAMPLE 8

Calcium sulfate dihydrate may be coated with calcium silicate as a part of the crutching procedure in a process for preparing a detergent composition. In a typical process, hot water at a temperature of about 75°C to about 100°C is charged to the crutcher in an amount to provide about 35% to about 45% water in the total crutcher charge. Next there is added sodium silicate having an $SiO_2$:$Na_2O$ ratio of 2.4 and a solids content of 46.8%. in the amount of 141 pounds, followed by 160 pounds of calcium sulfate dihydrate. The mixture is crutched for 20 minutes at a temperature of about 85°C to coat the particles with calcium silicate. The remainder of the components are then added, in this instance being 353 pounds of linear ($C_{13}$ av.) sodium alkylbenzenesulfonate containing 144 pounds of active surfactant, about 20 pounds of sodium sulfate and the balance being essentially water; 16 pounds of sodium toluenesulfonate, 3 pounds of sodium carboxymethylcellulose, 5 pounds of lauric isopropanolamide, 30 pounds of soda ash containing 99% sodium carbonate and 280 pounds of trisodium carboxymethyloxysuccinate. The resulting slurry is crutched for 30 minutes, and spray-dried to produce a particulate detergent composition having a water content of 10%.

EXAMPLE 9

This example demonstrates the use of calcium carbonate coated calcium sulfate dihydrate as a complete replacement for added sodium sulfate at levels of 12%, 22% and 28%, these percentages being expressed as anhydrous particles. The comparison is made by means of Terg-O-Tometer detergency tests conducted in the manner described in Example 2. The detergent components listed below are individually placed in the cup of a Terg-O-Tometer in amounts corresponding to 1.5 grams of total product having the following compositions, representing typical detergent formulations.

| | Percent by Weight | | | | | |
|---|---|---|---|---|---|---|
| | A | B | C | D | E | F |
| Linear alkylbenzenesulfonate[a] | 18 | 18 | 18 | 18 | 18 | 18 |
| Sodium carbonate | 40 | 40 | 40 | 40 | — | — |
| Sodium tripolyphosphate | — | — | — | — | 40 | 40 |
| $CaSO_4.2H_2O$ coated with $CaCO_3$[b] | 22 | — | 28 | — | 22 | — |
| $Na_2SO_4$ | — | 22 | — | 28 | — | 22 |
| Sodium silicate solids[c] | 10 | 10 | 10 | 10 | 10 | 10 |
| Water, total | 10 | 10 | 4 | 4 | 10 | 10 |
| | 100 | 100 | 100 | 100 | 100 | 100 |
| pH at start of wash | 10.4 | 10.4 | 10.3 | 10.4 | 9.8 | 9.8 |
| pH at end of wash | 10.3 | 10.3 | 10.2 | 10.3 | 9.7 | 9.7 |
| Gardner readings (av. of 2) | 57.1 | 55.5 | 56.2 | 54.6 | 58.0 | 57.5 |

[a]Sodium salt. The alkyl group averages about 13 carbon atoms. Added as 40.8% solution.
[b]Prepared as in Example 1. Percentages shown are percentages of anhydrous matter in coated particles containing 21% water.
[c]RU Silicate, $SiO_2$:$Na_2O$ = 2.4. Added as a 46.8% solution.

The Gardner readings are as defined in Example 2, i.e., the readings obtained on the aforementioned Gardner instrument. The higher the reading, the whiter the cloth. A review of the foregoing tabulation shows that calcium sulfate dihydrate coated with calcium carbonate is a suitable substitute for sodium sulfate over a wide range of proportions. In Examples A-D wherein sodium carbonate is the builder component, the aforementioned substitution results in significantly increased detergency. The increase, however, as provided by the aforementioned substitution, appears to be overshadowed by the greater detergent power of tripolyphosphate over sodium carbonate. This observation notwithstanding, the data show that the aforementioned substitution may be made in a tripolyphosphate-built detergent as well as in a carbonate-built detergent.

EXAMPLE 10

This example shows that calcium sulfate dihydrate coated with calcium carbonate may be partially substituted for sodium sulfate as a filler in typical detergent compositions, and that the substitution is particularly advantageous when the builder component is sodium carbonate. The comparative tests are made by means of Terg-O-Tometer detergency tests conducted in the manner described in Example 2. The detergent components listed below are individually placed in the cup of the Terg-O-Tometer in amounts corresponding to 1.5 grams of total product having the following compositions:

| | Percent by Weight | | | |
|---|---|---|---|---|
| | A | B | C | D |
| Linear alkylbenzene-sulfonate[a] | 18 | 18 | 18 | 18 |
| Sodium carbonate | 40 | 40 | — | — |
| Sodium tripolyphosphate | — | — | 40 | 40 |
| $CaSO_4.2H_2O$ coated with $CaCO_3$[b] | — | 11 | — | 11 |
| $Na_2SO_4$ | 22 | 11 | 22 | 11 |
| Sodium silicate solids[c] | 10 | 10 | 10 | 10 |
| Water, total | 10 | 10 | 10 | 10 |
| | 100 | 100 | 100 | 100 |
| pH at start of wash | 10.5 | 10.4 | 10.0 | 10.0 |
| pH at end of wash | 10.4 | 10.25 | 9.7 | 9.65 |
| Gardner reading (av. of 2) | 52.2 | 54.7 | 56.4 | 57.2 |

[a], [b], [c], as defined in Example 9.

EXAMPLE 11

This example shows that calcium sulfate dihydrate coated with calcium carbonate can be substituted for sodium sulfate as a filler in a detergent composition based on a nonionic surfactant. In this series of tests, the surfactant is Sterox SN. The following components are individually placed in the cup of a Terg-O-Tometer in amounts corresponding to 1.5 grams of total product having the following composition:

| | Percent by Weight | | | | | |
|---|---|---|---|---|---|---|
| | A | B | C | D | E | F |
| Nonionic surfactant[a] | 10 | 10 | 10 | 10 | 10 | 10 |
| Sodium carbonate | 50 | 50 | 50 | — | — | — |
| Sodium tripoly-phosphate | — | — | — | 50 | 50 | 50 |
| $CaSO_4.2H_2O$ coated with $CaCO_3$[b] | 20 | — | 10 | 20 | — | 10 |
| $Na_2SO_4$ | — | 20 | 10 | — | 20 | 10 |
| Sodium silicate solids[c] | 10 | 10 | 10 | 10 | 10 | 10 |
| Water, total | 10 | 10 | 10 | 10 | 10 | 10 |
| | 100 | 100 | 100 | 100 | 100 | 100 |
| pH at start of wash | 10.4 | 10.5 | 10.5 | 10.0 | 10.0 | 10.0 |
| pH at end of wash | 10.4 | 10.4 | 10.3 | 9.7 | 9.7 | 9.7 |
| Gardner reading (av. of 2) | 56.7 | 55.0 | 53.9 | 51.8 | 50.9 | 52.8 |

[a]Trademark of the Monsanto Chemical Company for a nonionic surfactant which is the 13.5 mole ethoxylate of a blend of $C_{14}$ and $C_{15}$ linear primary alcohols.
[b], [c], as defined in Example 9.

EXAMPLES 12–17

Forty grams of $CaSO_4.2H_2O$ are dispersed in 400 cc of water. The amount of $Na_2CO_3$ noted below is then added and the mixture either stirred at room temperature for 30 minutes or at 60°C for 30 minutes as noted. In all cases, the resulting calcium carbonate coated calcium sulfate dihydrate is filtered off, washed with acetone and further dried in a vacuum oven at 50°C to produce a powdery product. The products are then used in the detergent compositions and evaluation of Examples 18–23.

| Example | Grams $Na_2CO_3$ used | Temperature | Composition of Product* % $CaSO_4.2H_2O$ | % $CaCO_3$ |
|---|---|---|---|---|
| 12 | 2 | room temperature | 93 | 5 |
| 13 | 4 | room temperature | 89 | 10 |

-continued

| Example | Grams $Na_2CO_3$ used | Temperature | Composition of Product* % $CaSO_4.2H_2O$ | % $CaCO_3$ |
|---|---|---|---|---|
| 14 | 8 | room temperature | 80 | 20 |
| 15 | 2 | 60°C | 94 | 4 |
| 16 | 4 | 60°C | 88 | 10 |
| 17 | 8 | 60°C | 77 | 22 |

*Balance of product where analysis adds up to less than 100% is $Na_2CO_3$ and/or $Na_2SO_4$.

A scanning electron microscopical investigation of the above samples indicates the coated products prepared at room temperature to contain $CaSO_4.2H_2O$ particles having a cross sectional diameter in the 7-25$\mu$ range interspersed with $CaCO_3$ particles have a diameter in the 1-3$\mu$ range. The products prepared at 60°C show a similar picture except that the $CaCO_3$ particles exhibit considerable agglomeration with the aggregates ranging from 4-35$\mu$ in diameter.

EXAMPLES 18–21

These examples demonstrate the use of calcium sulfate dihydrate coated with various amounts of calcium carbonate as a complete replacement for sodium sulfate at a 22% level in a carbonate built anionic formulation. The comparison is made by means of Terg-O-Tometer detergency tests conducted in the manner described in Example 2. The detergent components listed below are individually placed in the cup of a Terg-O-Tometer in amounts corresponding to 1.5 grams of total product having the following compositions:

| | Percent By Weight | | | |
|---|---|---|---|---|
| | 18 | 19 | 20 | 21 |
| Linear alkylbenzene sulfonate[a] | 18 | 18 | 18 | 18 |
| Sodium carbonate | 40 | 40 | 40 | 40 |
| $CaSO_4.2H_2O$ coated with $CaCO_3$[b] | | | | |
| according to Example 12 | 22 | — | — | — |
| Example 13 | — | 22 | — | — |
| Example 14 | — | — | 22 | — |
| $Na_2SO_4$ | — | — | — | 22 |
| Sodium silicate solids[c] | 10 | 10 | 10 | 10 |
| Water, total | 10 | 10 | 10 | 10 |
| | 100 | 100 | 100 | 100 |
| pH at start of wash | 10.3 | 10.2 | 10.3 | 10.4 |
| pH at end of wash | 10.1 | 10.1 | 10.1 | 10.3 |
| Gardner readings (avg. of 2) | 51.2 | 53.2 | 53.3 | 53.3 |

[a], [b], and [c], as defined in Example 9.

The results of these tests show that the $CaCO_3$ coated $CaSO_4.2H_2O$ prepared at room temperature must contain at least about 10% $CaCO_3$ to bring the detergency of the formulation up to parity with the corresponding sodium sulfate containing formulation. 37

EXAMPLES 22–25

The procedures of Examples 18–20 are repeated using the $CaSO_4.2H_2O$ coated with $CaCO_3$ and prepared according to Examples 15-17, respectively, in place of those from Examples 12–14. Gardner readings are 49.9, 51.2, 51.8 and 52.3 ($Na_2SO_4$ control), respectively, indicating that when the coating process is carried out at the higher temperature of 60°C approximately 20% calcium carbonate is required in the coated particles to bring the detergency of the formulation to parity with the control sodium sulfate-containing formulation.

EXAMPLES 26–33

Substantially similar results are obtained as in Examples 18–21 when the sodium linear alkylbenzene sulfonate component in the formulations of Examples 18–21 is replaced with sodium N-2-hydroxyalkyl-($C_{14}$-$C_{16}$)-N-methyltaurate (Examples 26–29) and with cocodimethylsulfopropyl betaine (Examples 30–33).

Having thus described the invention, modifications within the spirit thereof will occur to those skilled in the art, and the invention is to be limited only within the scope of the appended claims.

I claim:

1. Particulate calcium sulfate dihydrate having a coating of a substantially water-insoluble calcium salt on and interspersed with the particles thereof, said coating comprising 10% to 75% by weight based on the total combined weight of the water-insoluble calcium salt and calcium sulfate dihydrate of a substance selected from the group consisting of calcium carbonate, calcium silicate, calcium sulfite, calcium orthophosphate, and hydroxyapatite.

2. Coated particulate calcium sulfate dihydrate in accordance with claim 1 wherein said substantially water-insoluble calcium salt is calcium carbonate.

3. Coated particulate calcium sulfate dihydrate in accordance with claim 1 wherein said substantially water-insoluble calcium salt is calcium silicate.

4. A particulate detergent composition comprising about 5% to about 30% of an anionic, nonionic, amphoteric or zwitterionic surfactant, about 10% to about 60% of a detergent builder, and about 1% to about 75% of a detergent filler comprising particulate calcium sulfate dihydrate having a coating of a substantially water-insoluble calcium salt on and interspersed with the particles thereof, said coating comprising 10% to 75% by weight based on the total combined weight of the water-insoluble calcium salt and calcium sulfate dihyrate a substance selected from the group consisting of calcium carbonate, calcium silicate, calcium sulfite, calcium orthophosphate, hydroxyapatite, and a calcium salt of an alkanoic acid having about 12 to about 22 carbon atoms.

5. A particulate detergent composition as defined in claim 4 wherein said water-insoluble calcium salt is calcium carbonate.

6. A particulate detergent composition as defined in claim 4 wherein said water-insoluble calcium salt is calcium silicate.

7. A particulate detergent composition as defined in claim 4 wherein said water-insoluble calcium salt is a calcium salt of an alkanoic acid having about 12 to about 22 carbon atoms.

8. A particulate detergent composition as defined in claim 4 wherein said water-insoluble calcium salt is calcium stearate.

9. A particulate detergent composition as defined in claim 4 wherein said water-insoluble calcium salt is calcium laurate.

10. A process for producing a detergent composition comprising i. charging into a crutcher about 35% to about 45% water, the percentages being based on total cruthcer charge, by weight, ii. mixing therewith about 10% to about 60% of sodium carbonate, iii. adding to said mixture about 1% to about 75% of particulate calcium sulfate dihydrate, iv. agitating said mixture until a coating of calcium carbonate forms on said particles of calcium sulfate dihydrate, while maintaining the temperature of the mixture between 20°C and about 100°C, v. adding to said mixture 0% to about 30% sodium sulfate, vi. adding about 5% to about 30% of a surfactant having detergent properties to form a built detergent slurry in said crutcher, and vii. spray drying said slurry, said percentages set forth in (ii), (iii), (v) and (vi) being by weight of the spray-dried detergent composition, and the total of the percentages of said coated calcium sulfate dihydrate and sodium sulfate being about 3% to about 75%.

11. The process in accordance with claim 10 wherein step (iv) is carried out in the temperature range of 20°–60°C.

12. The process in accordance with claim 10 wherein step (iv) is carried out in the temperature range of 20°–30°C.

* * * * *